US008986041B2

(12) United States Patent
Oka et al.

(10) Patent No.: US 8,986,041 B2
(45) Date of Patent: Mar. 24, 2015

(54) CONNECTOR AND MATING CONNECTOR

(71) Applicant: Japan Aviation Electronics Industry, Limited, Tokyo (JP)

(72) Inventors: Toshihiro Oka, Tokyo (JP); Nobuhiro Ogawa, Tokyo (JP); Shigeyasu Kitamura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 72 days.

(21) Appl. No.: 13/887,533

(22) Filed: May 6, 2013

(65) Prior Publication Data

US 2013/0303015 A1 Nov. 14, 2013

(30) Foreign Application Priority Data

May 9, 2012 (JP) ..... 2012-107832

(51) Int. Cl.

| | |
|---|---|
| ***H01R 13/629*** | (2006.01) |
| ***H01R 9/03*** | (2006.01) |
| ***H01R 9/05*** | (2006.01) |
| *H01R 13/422* | (2006.01) |
| *H01R 13/50* | (2006.01) |

(52) U.S. Cl.

CPC ..... *H01R 13/629* (2013.01); *H01R 9/032* (2013.01); *H01R 9/0518* (2013.01); *H01R 13/4223* (2013.01); *H01R 13/50* (2013.01)

USPC ..... 439/374

(58) Field of Classification Search

USPC ..... 439/374, 353, 159, 607.01, 607.55, 439/607.43, 607.48

See application file for complete search history.

(56) References Cited

U.S. PATENT DOCUMENTS

| | | | | |
|---|---|---|---|---|
| 4,501,459 | A * | 2/1985 | Chandler et al. | 439/295 |
| 4,577,920 | A * | 3/1986 | Coldren et al. | 439/607.43 |
| 4,889,503 | A * | 12/1989 | Philippson et al. | 439/607.45 |
| 5,035,652 | A * | 7/1991 | Shibano | 439/607.47 |
| 5,518,421 | A * | 5/1996 | Davis | 439/607.5 |
| 6,196,874 | B1 * | 3/2001 | Wu | 439/607.58 |
| 6,491,530 | B2 * | 12/2002 | Koide et al. | 439/92 |
| 6,960,025 | B2 * | 11/2005 | Gurreri | 385/58 |
| 7,104,842 | B1 * | 9/2006 | Huang et al. | 439/607.55 |
| 7,153,035 | B2 * | 12/2006 | Taira et al. | 385/76 |

(Continued)

FOREIGN PATENT DOCUMENTS

| | | |
|---|---|---|
| JP | 2009-043704 | 2/2009 |
| JP | 4541999 | 9/2010 |

OTHER PUBLICATIONS

Japanese Office Action dated Jul. 4, 2013 in Japanese Application No. 2012-107832 with English translation.

*Primary Examiner* — Alexander Gilman
(74) *Attorney, Agent, or Firm* — Collard & Roe, P.C.

(57) ABSTRACT

A connector comprises a housing and a terminal assembly accommodated in the housing. The housing has two sidewalls in a lateral direction and a coupling portion. Each of the sidewalls has a through hole, an upper sidewall and a lower sidewall. The through hole pierces the sidewall in the lateral direction. The upper sidewall is located on the through hole while the lower sidewall is located under the through hole. The coupling portion is located at a front side of the through hole. The upper side wall and the lower sidewall of each of the sidewalls are coupled by the coupling portion. The terminal assembly has a shell formed with a protrusion. The protrusion is visible through the through hole from outside in the lateral direction.

14 Claims, 9 Drawing Sheets

(56) References Cited

U.S. PATENT DOCUMENTS

| | | | | |
|---|---|---|---|---|
| 7,597,563 | B2 * | 10/2009 | Shinkawa et al. | 439/98 |
| 7,677,936 | B2 * | 3/2010 | Sato et al. | 439/892 |
| 7,753,732 | B2 * | 7/2010 | Kameyama et al. | 439/607.27 |
| 8,029,319 | B2 * | 10/2011 | Kameyama et al. | 439/607.01 |
| 8,454,395 | B2 * | 6/2013 | Xu et al. | 439/852 |
| 2002/0142658 | A1 * | 10/2002 | Koide et al. | 439/610 |
| 2005/0196106 | A1 * | 9/2005 | Taira et al. | 385/78 |
| 2009/0023339 | A1 | 1/2009 | Kameyama et al. | |
| 2009/0253295 | A1 | 10/2009 | Kameyama et al. | |

* cited by examiner

CONNECTOR AND MATING CONNECTOR

CROSS REFERENCE TO RELATED APPLICATIONS

An applicant claims priority under 35 U.S.C. §119 of Japanese Patent Application No. JP2012-107832 filed May 9, 2012.

BACKGROUND OF THE INVENTION

This invention relates to a connector having a shield structure.

For example, this type of connector is disclosed in JP-B 4541999 (Patent Document 1) and JP-A 2009-43704 (Patent Document 2), contents of which are incorporated herein by reference.

The connector of each of Patent Documents 1 and 2 is configured to be connected to a mating connector. The connector comprises a shell and a signal contact while the mating connector comprises a mating shell provided with a contact portion which is resiliently deformable. When the connector is connected to the mating connector, the contact portion of the mating shell is brought into contact with the shell so that the shell and the mating shell are electrically connected with each other. Accordingly, the signal contact is electrically shielded from the outside.

As shown in FIG. 16, the connector of Patent Document 1 comprises a housing which is formed with a slit. The slit is formed on a sidewall of the housing so as to extend to a front end of the housing. Accordingly, a front side of the housing is separated into an upper part and a lower part by the slit. The contact portion of the mating shell moves in the slit to be brought into contact with the shell so that the mating shell is electrically connected with the shell.

As shown in FIG. 17, the connector of Patent Document 2 comprises a housing which is formed with a slender through hole. The through hole pierces a sidewall of the housing. Although the through hole extends long toward a front end of the housing, the through hole does not reach the front end of the housing. Accordingly, the front end of the housing is not separated into two parts. The contact portion of the mating shell brought into contact with the shell through the through hole so that the mating shell is electrically connected with the shell.

The front side of the housing of the connector of Patent Document 1 is divided into the two parts. Accordingly, the housing has a low strength.

The front side of the housing of the connector of Patent Document 2 is not divided into two parts. However, when the connector is mated with the mating connector, the contact portion of the mating connector surmounts the housing to enter the through hole. Accordingly, the housing tends to be shaven by the contact portion. The shavings might remain on the shell so that the contact portion of the mating shell might not be properly brought into contact with the shell.

SUMMARY OF THE INVENTION

It is therefore an object of the present invention to provide a connector having a structure which is preventable a contact failure caused by shavings, foreign bodies and contaminations.

One aspect of the present invention provides a connector comprising a housing and a terminal assembly. The housing has an accommodation portion, two sidewalls and a coupling portion. The accommodation portion is located between the two sidewalls in a lateral direction. Each of the sidewalls has a through hole, an upper sidewall and a lower sidewall. The through hole pierces the sidewall in the lateral direction to reach the accommodation portion. The upper sidewall is located on the through hole in an up-down direction perpendicular to the lateral direction. The lower sidewall is located under the through hole in the up-down direction. The coupling portion is located at a front side of the through hole in a front-rear direction perpendicular to both the lateral direction and the up-down direction. The coupling portion couples the upper side wall and the lower sidewall to each other. The terminal assembly is accommodated in the accommodation portion along the front-rear direction. The terminal assembly has a shell. The shell has two side surfaces. Each of the side surfaces has a body portion and a protrusion. The protrusion protrudes outward in the lateral direction from the body portion. The protrusion is visible through the through hole from outside in the lateral direction.

An appreciation of the objectives of the present invention and a more complete understanding of its structure may be had by studying the following description of the preferred embodiment and by referring to the accompanying drawings.

Figure 1:
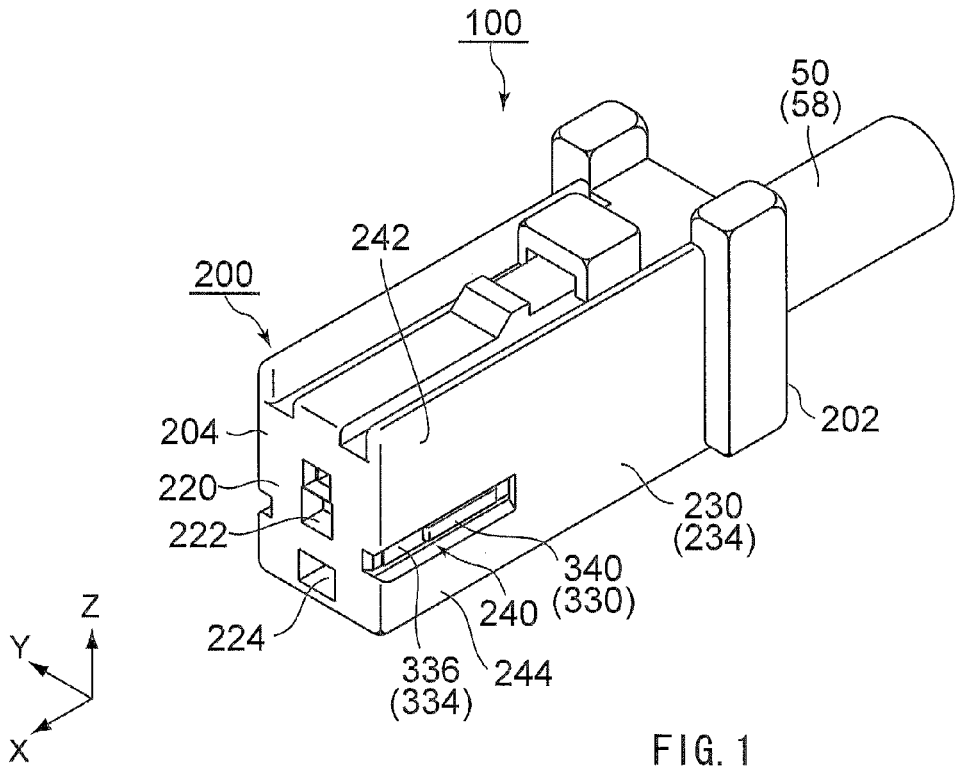
FIG. 1 is a perspective view showing a connector according to an embodiment of the present invention, wherein the connector is connected to a coaxial cable.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 1 to 5, a connector 100 according to an embodiment of the present invention comprises an outer housing (housing) 200 made of an insulating material and a terminal assembly 300.

Figure 8:
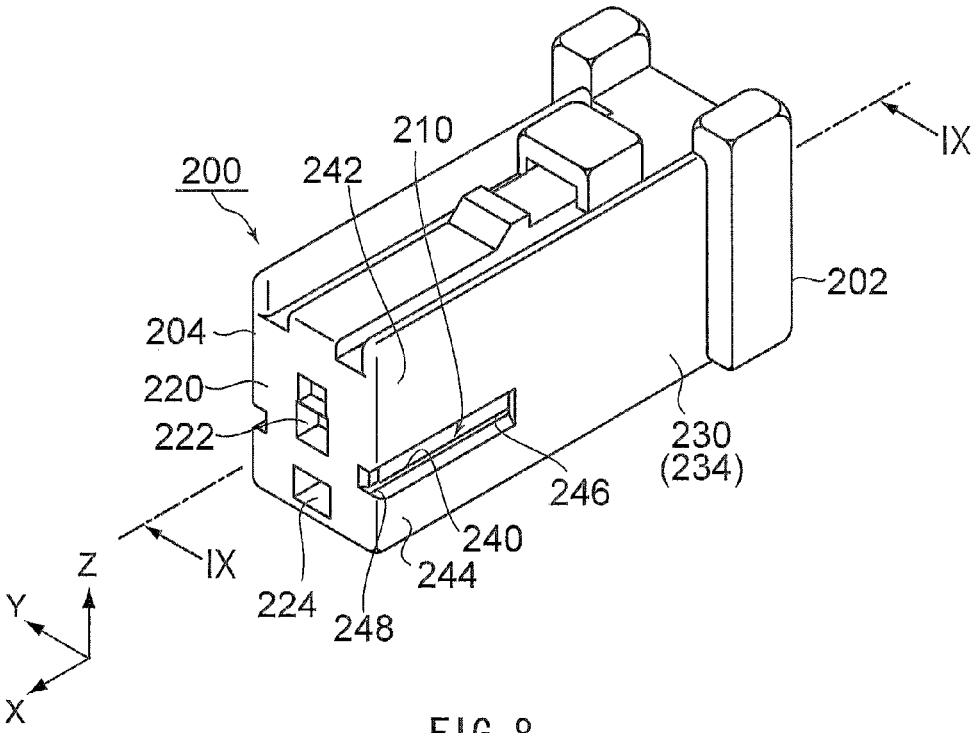
FIG. 8 is a perspective view showing a housing of the connector of FIG. 1.
Figure 9:
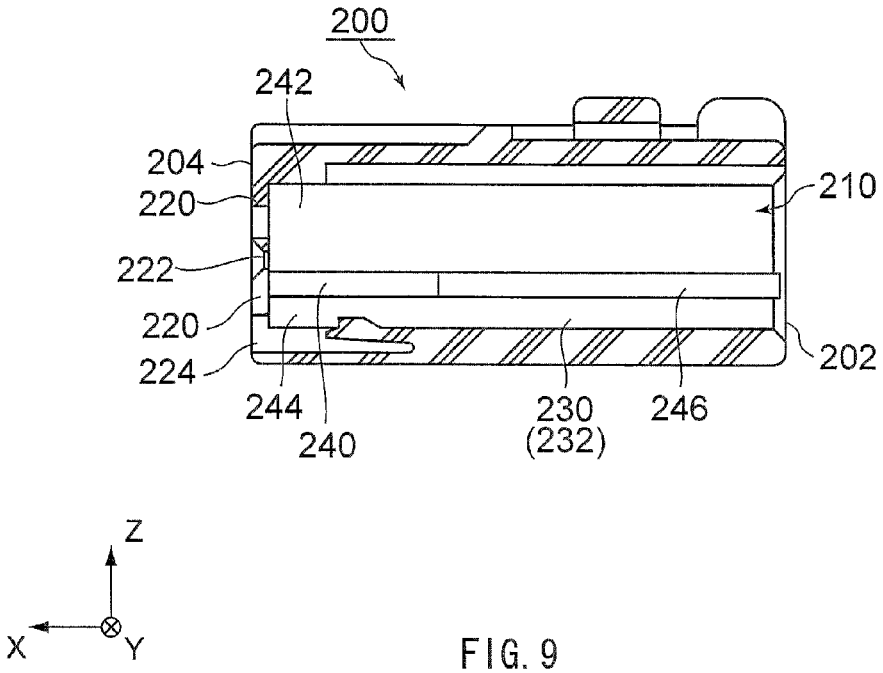
FIG. 9 is a side, cross-sectional view showing the housing of FIG. 8, taken along line IX-IX.

Referring to FIGS. 8 and 9, the outer housing 200 has a front end 204 and a rear end 202 in a front-rear direction (X-direction). The outer housing 200 is provided with an accommodation portion 210. The accommodation portion 210 extends forward (i.e. along the positive X-direction) from a rear end 202 of the outer housing 200. The outer housing 200 has a front wall (coupling portion) 220. The front wall 220 is located in front of the accommodation portion 210. The front wall 220 is formed with an insertion hole 222 and a hole 224. The hole 224 is located under the insertion hole 222 in an up-down direction (Z-direction). Each of the insertion hole 222 and the hole 224 extends between the front end 204 of the outer housing 200 and the accommodation portion 210. In other words, each of the insertion hole 222 and the hole 224 pierces the front wall 220 in the front-rear direction (X-direction).

As shown in FIGS. 3, 5, 8 and 9, the outer housing 200 has two sidewalls 230. The accommodation portion 210 is located between the two sidewalls 230 in a lateral direction (Y-direction). The two sidewalls 230 are coupled by the front wall 220 to each other at a front side (i.e. positive X-side) of the accommodation portion 210. Each of the sidewalls 230 has a through hole 240, an upper sidewall 242 and a lower sidewall 244. The through hole 240 pierces the sidewall 230 in the lateral direction (Y-direction) to reach the accommodation portion 210. Accordingly, the accommodation portion 210 communicates with the outside of the outer housing 200 via the through hole 240. The through hole 240 according to the present embodiment is a slender hole having a rectangular shape. In detail, the through hole 240 is long in the front-rear direction (X-direction) and short in the up-down direction (Z-direction). The through hole 240 according to the present embodiment does not reach the front end 204 of the outer housing 200. The upper sidewall 242 is located on the through hole 240 in the up-down direction (Z-direction). The lower sidewall 244 is located under the through hole 240 in the up-down direction (Z-direction). The front wall 220 is located at a front side (i.e. positive X-side) of the through hole 240 in the front-rear direction (X-direction). As can be seen from the above description, the upper sidewall 242 and the lower sidewall 244, which are parts of the sidewall 230 of the outer housing 200, are coupled to each other by the front wall 220. Thus, a part of the front wall 220 serves as a coupling portion which couples the upper sidewall 242 and the lower sidewall 244 to each other.

Figure 5:
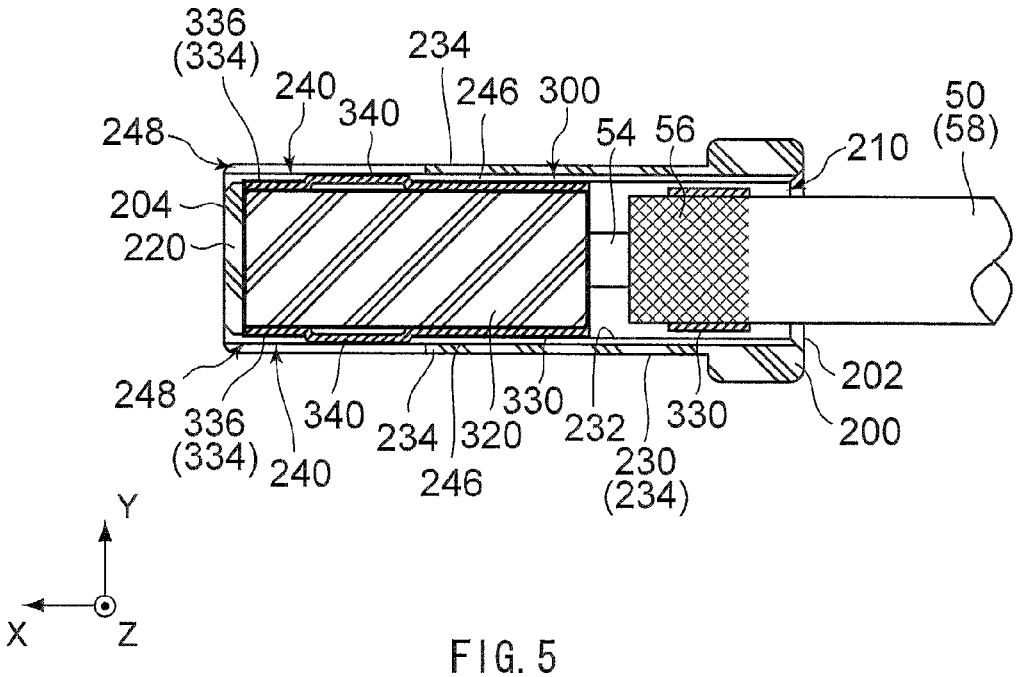
FIG. 5 is a plan, cross-sectional view showing the connector of FIG. 1, taken along line V-V, wherein the coaxial cable is shown in a plan view.
Figure 6:
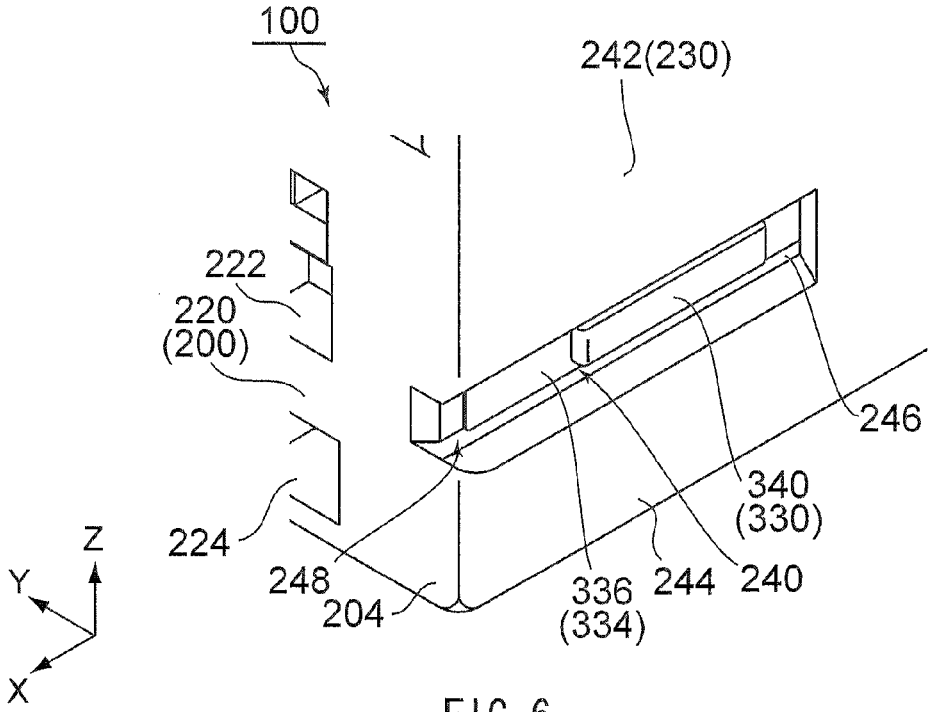
FIG. 6 is a partially-enlarged, perspective view showing about a through hole of the connector of FIG. 1.
Figure 7:
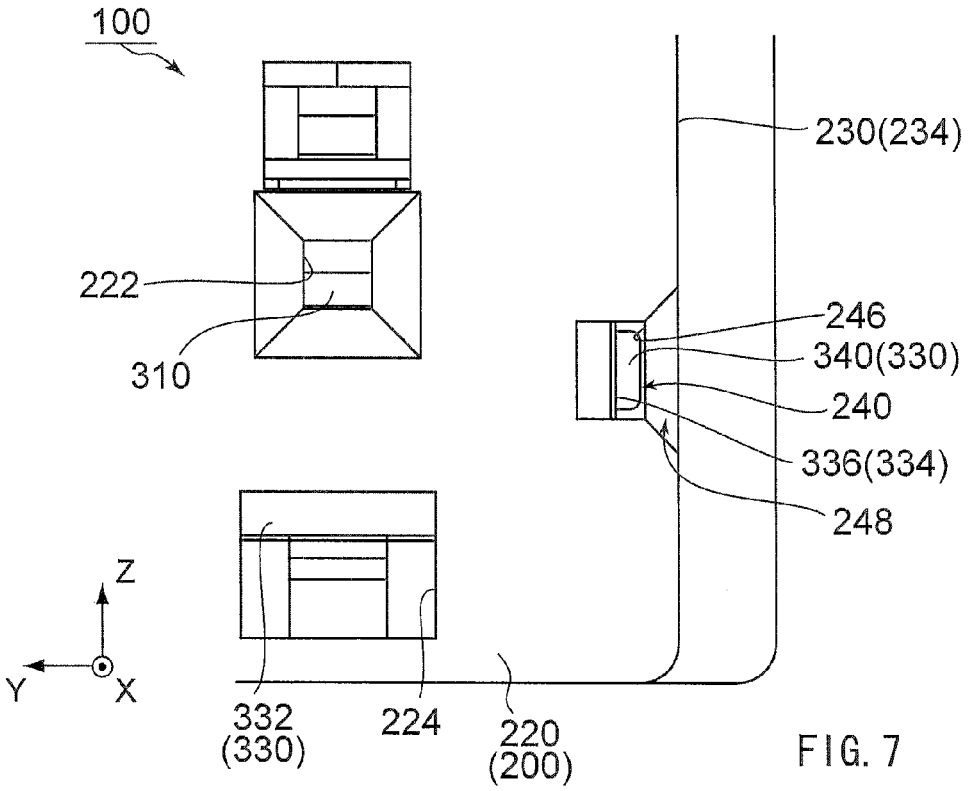
FIG. 7 is a partially-enlarged, front view showing about the through hole of the connector of FIG. 3.

As can be seen from FIGS. 6, 8 and 9, each of the sidewalls 230 is formed with an inner ditch 246 and a guide ditch 248. The inner ditch 246 extends forward (i.e. along the positive X-direction) from the rear end 202 to the front end 204. The guide ditch 248 extends rearward (i.e. along the negative X-direction) from the front end 204. As shown in FIGS. 5 and 9, the inner ditch 246 is formed on an inner surface 232 of the sidewall 230. On the contrary, as shown in FIGS. 6 to 8, most of the guide ditch 248 is formed on an outer surface 234 of the sidewall 230. As can be seen from FIGS. 6 and 8, according to the present embodiment, an overlapped part of the inner ditch 246 and the guide ditch 248 constitutes the through hole 240. In detail, according to the present embodiment, each of a part of the inner ditch 246 and a part of the guide ditch 248 constitutes, at least in part, the through hole 240. Moreover, a part of the inner ditch 246 constitutes, at least in part, the guide ditch 248. If viewed from a different angle, a part of the guide ditch 248 pierces the sidewall 230 of the outer housing 200 in the lateral direction (Y-direction) to constitute, at least in part, the through hole 240.

Figure 10:
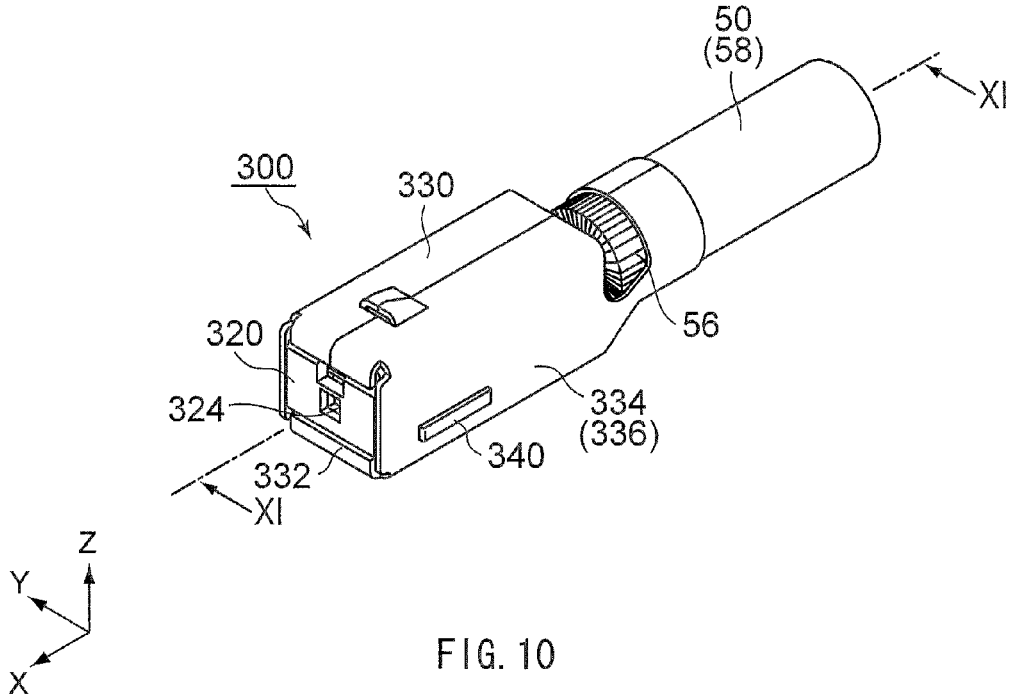
FIG. 10 is a perspective view showing a terminal assembly of the connector of FIG. 1.
Figure 11:
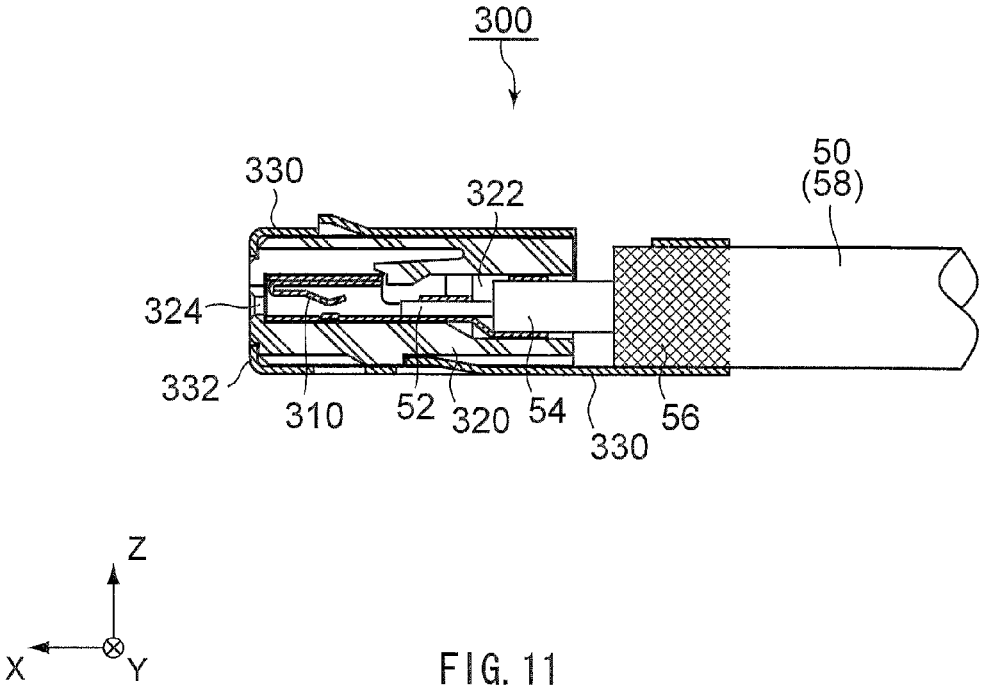
FIG. 11 is a side, cross-sectional view showing the terminal assembly of FIG. 10, taken along line XI-XI, wherein the coaxial cable is shown in a side view.

Referring to FIGS. 4, 5, 10 and 11, the terminal assembly 300 is configured to be connected to a coaxial cable 50. The terminal assembly 300 has a contact 310 made of a conductive material, an inner housing 320 made of an insulating material and a shell 330 made of a metal. As shown in FIG. 11, the coaxial cable 50 has an inner conductor 52, an insulator 54, an outer conductor 56 and an outer jacket 58. The inner conductor 52 and the outer conductor 56 are connected to the contact 310 and the shell 330, respectively.

As best shown in FIG. 11, the contact 310 is a female contact connectable to a mating contact which is a male contact or a pin contact. The contact 310 is held by the inner housing 320. In detail, the inner housing 320 has an accommodation portion 322 formed therewithin and an insertion hole 324 formed at a front end thereof. The mating contact is insertable into the accommodation portion 322 through the insertion hole 324. The contact 310 is accommodated in the accommodation portion 322 so as to be connectable to the inserted mating contact.

As shown in FIGS. 10 and 11, the shell 330 covers, at least in part, the inner housing 320. The shell 330 is formed from a single metal plate which is punched and pressed. The shell 330 has a front surface 332, two side surfaces 334 and a bottom surface. The front surface 332 of the shell 330 constitutes, at least in part, a front surface of the terminal assembly 300. More specifically, the front surface 332 extends from the bottom surface of the shell 330 so as to cover a part of a front end of the inner housing 320. Each of the side surfaces 334 has a body portion 336 and a protrusion 340. The protrusion 340 protrudes outward in the lateral direction (Y-direction) from the body portion 336 of the side surface 334. The protrusion 340 roughly has a slender, rectangular shape which is long in the front-rear direction (X-direction) while short in the up-down direction (Z-direction).

Figure 4:
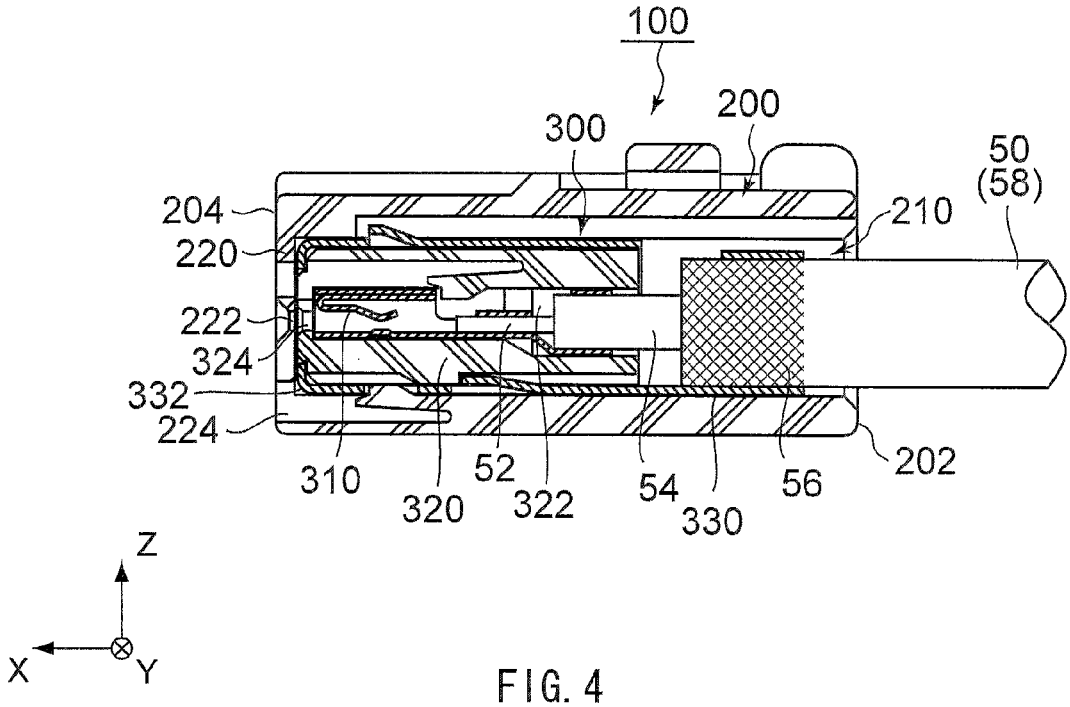
FIG. 4 is a side, cross-sectional view showing the connector of FIG. 1, taken along line IV-IV, wherein the coaxial cable is shown in a side view.

As shown in FIG. 4, the terminal assembly 300, which has the aforementioned structure, is inserted forward (i.e. along the positive X-direction) from the rear end 202 of the outer housing 200 to be accommodated in the accommodation portion 210. As can be seen from FIGS. 5 to 7, when the terminal assembly 300 is accommodated into the accommodation portion 210, each of the protrusions 340 passes through the inside of the inner ditch 246 to move forward (i.e. along the positive X-direction). In other words, the inner ditch 246 allows the protrusion 340 to move forward when the terminal assembly 300 is accommodated into the accommodation portion 210.

Figure 2:
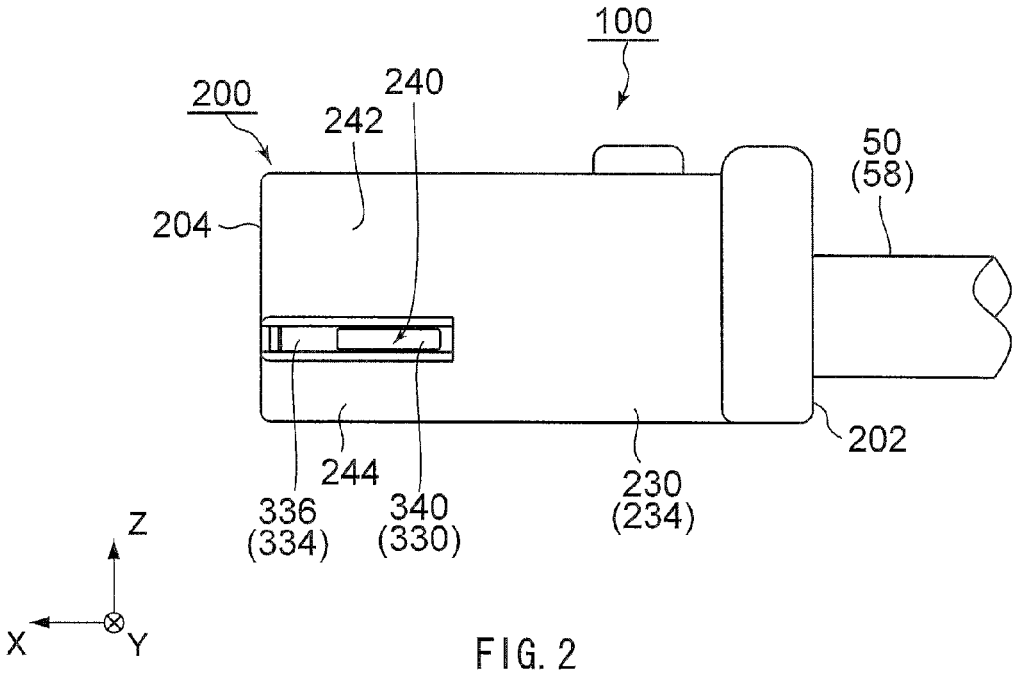
FIG. 2 is a side view showing the connector of FIG. 1.
Figure 3:
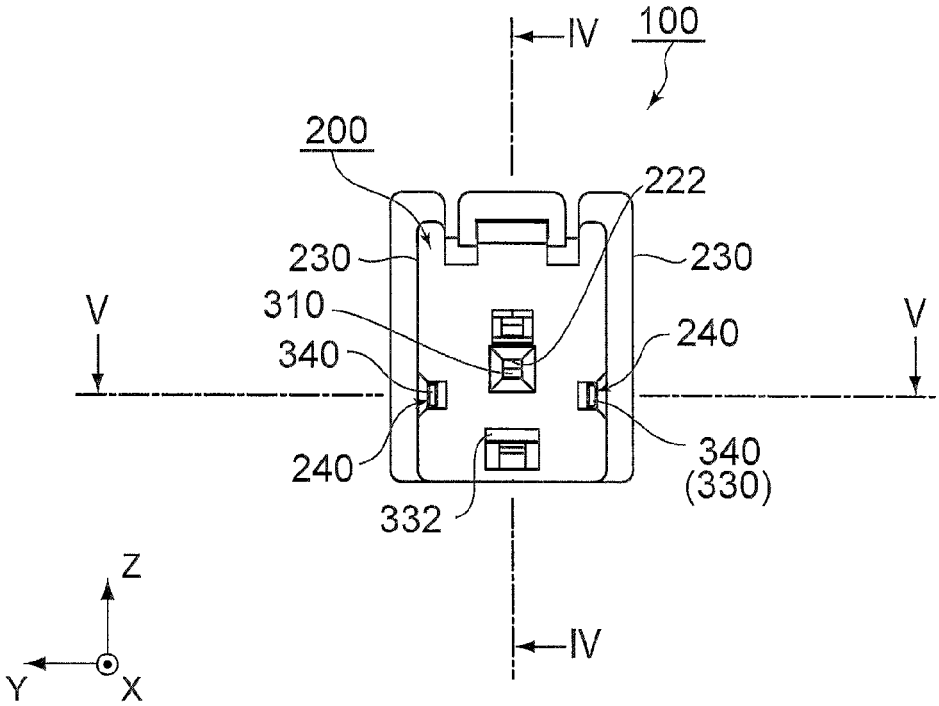
FIG. 3 is a front view showing the connector of FIG. 1.

As shown in FIGS. 1 to 3, the protrusions 340 are located in the through holes 240, respectively, under a state where the terminal assembly 300 is accommodated in the accommodation portion 210.

As shown in FIGS. 1, 2 and 6, the protrusions 340 are visible through the through holes 240 from the outside in the lateral direction (Y-direction), respectively. Moreover, according to the present embodiment, each of the body portions 336 is also partially visible through the through hole 240 from the outside in the lateral direction (Y-direction).

As described above, the outer housing 200 according to the present embodiment is provided with the guide ditch 248 extending along the front-rear direction (X-direction) from the front end 204 to the through hole 240 (see FIG. 8).

Accordingly, as shown in FIGS. 3 and 7, the protrusion 340 is visible from front (i.e. the positive X-side) of the outer housing 200 through the guide ditch 248.

As best shown in FIG. 5, the protrusion 340 according to the present embodiment is located inward of the outer surface 234 of the sidewall 230 of the outer housing 200 in the lateral direction (Y-direction). Accordingly, the protrusion 340 is protected by the outer housing 200.

Moreover, as best shown in FIG. 5, according to the present embodiment, a shortest distance between the two guide ditches 248 in the lateral direction (Y-direction) is shorter than a shortest distance between the two side surfaces 334 of the shell 330 in the lateral direction (Y-direction). Accordingly, as best shown in FIG. 7, a front end of the body portion 336 of each of the side surfaces 334 is also visible from front (i.e. the positive X-side) of the outer housing 200 through the guide ditch 248.

As shown in FIG. 4, the insertion hole 324 of the inner housing 320 of the terminal assembly 300 and the insertion hole 222 of the outer housing 200 are arranged on a common straight line in parallel to the front-rear direction (X-direction). Accordingly, as shown in FIG. 7, the contact 310 is visible from front (i.e. the positive X-side) of the connector 100 through the insertion hole 222 and the insertion hole 324. Accordingly, a mating contact, which is a male contact or a pin contact, is able to be inserted through the insertion hole 222 and the insertion hole 324 to be brought into contact with the contact 310.

As shown in FIGS. 3 and 7, the hole 224 according to the present embodiment is located in front of the front surface 332 of the shell 330. Accordingly, the front surface 332 of the shell 330 is partially visible from front (i.e. the positive X-side) of the connector 100 through the hole 224. Moreover, the hole 224 according to the present embodiment reaches the front surface 332 of the shell 330 in the front-rear direction (X-direction). In other words, the front surface 332 of the shell 330 is connected with the outside of the connector 100 via the hole 224. Accordingly, when a static electricity is applied to a front end of the connector 100, the static electricity may be grounded to the shell 330.

As shown in FIGS. 12 to 15, a mating connector 500 according to the present embodiment is configured to be mounted on and fixed to a circuit board (not shown). The mating connector 500 is mateable with the connector 100 along the front-rear direction (X-direction). The mating connector 500 comprises a mating contact 510 made of a conductive material, a mating housing 520 made of an insulating material and a mating shell 550 made of a metal. The mating connector 500 further comprises a mating end (i.e. the negative X-side end) configured to be mated with the connector 100.

Figure 14:
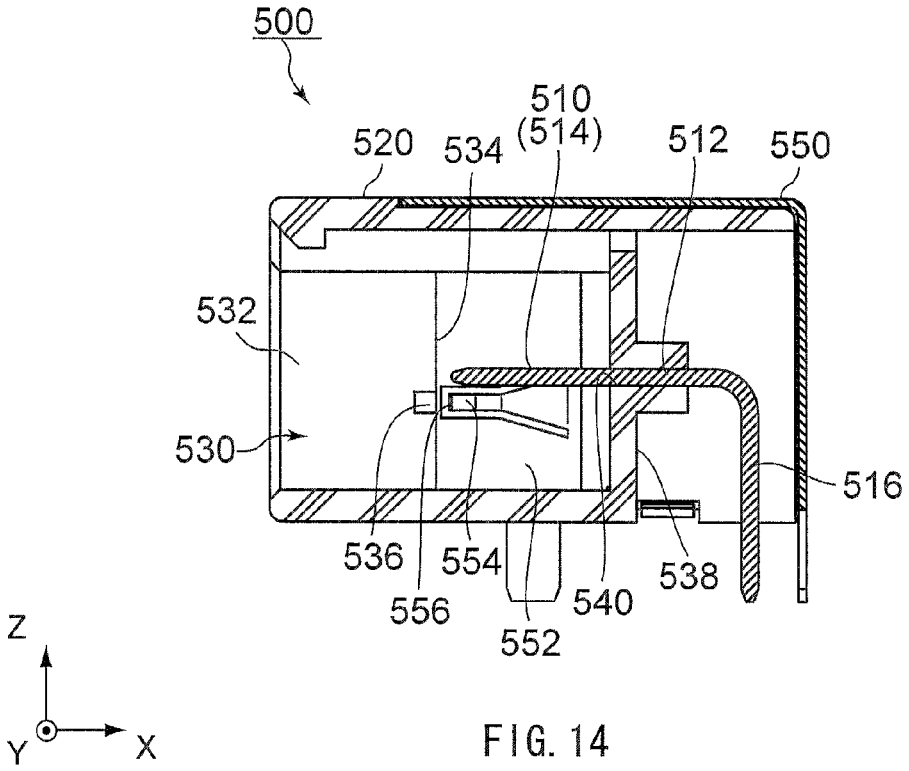
FIG. 14 is a side, cross-sectional view showing the mating connector of FIG. 13, taken along line XIV-XIV.

As shown in FIG. 14, the mating contact 510 has an L-like shape. In detail, the mating contact 510 has a held portion 512, a contact portion 514 and a terminal portion 516. The held portion 512 is held by the mating housing 520. The contact portion 514 has a pin-like shape which extends in a horizontal plane (according to the present embodiment, along the negative X-direction) from the held portion 512. The terminal portion 516 extends downward (i.e. along the negative Z-direction) from the held portion 512.

The mating housing 520 has a receive portion 530. The receive portion 530 receives the front end 204, which is a mating end of the connector 100, when the mating connector 500 is mated with the connector 100. The receive portion 530 has two sidewalls 532. Each of the sidewalls 532 is formed with a window 534. The window 534 pierces the sidewall 532 in the lateral direction (Y-direction). As can be seen from FIG. 14, the window 534 according to the present embodiment occupies about a half of the sidewall 532.

Figure 13:
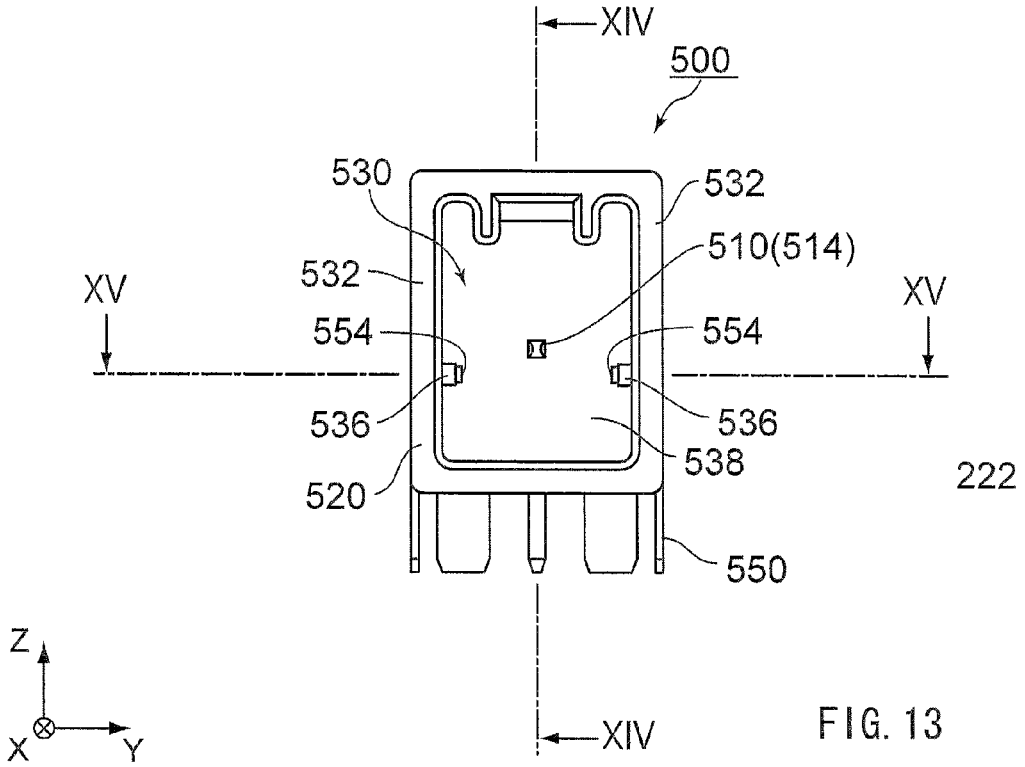
FIG. 13 is a front view showing the mating connector of FIG. 12.
Figure 15:
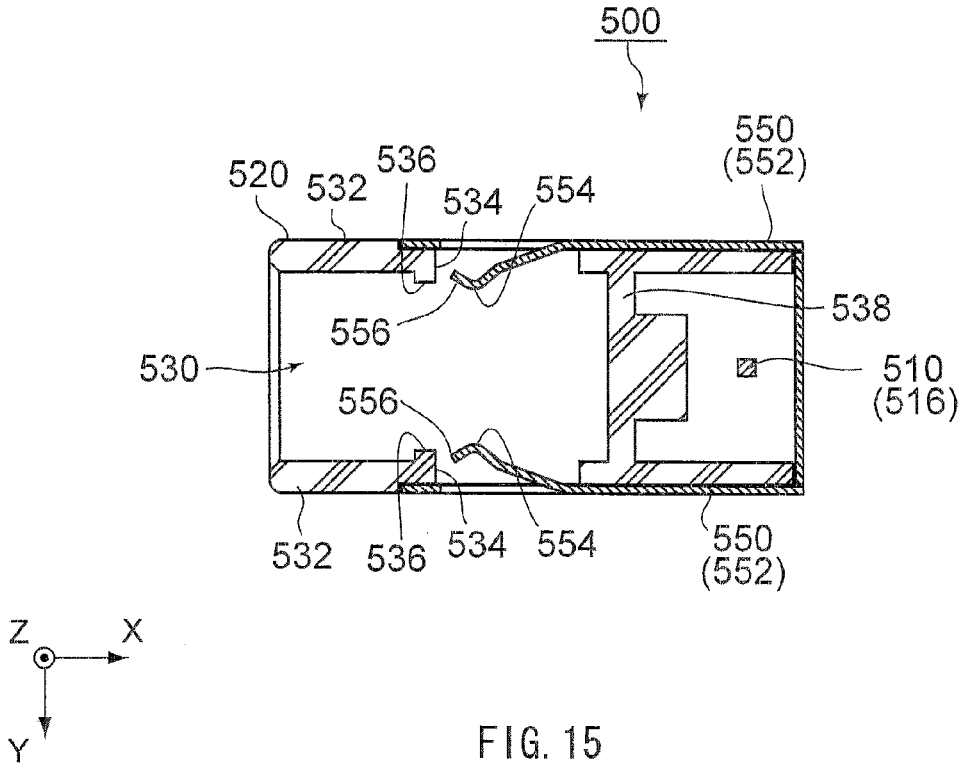
FIG. 15 is a plan, cross-sectional view showing the mating connector of FIG. 13, taken along line XV-XV.
Figure 16:
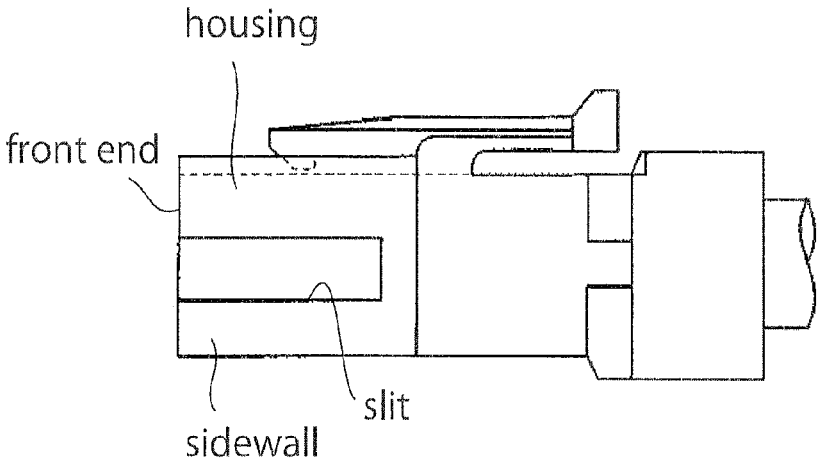
FIG. 16 PRIOR ART
FIG. 16 is a side view showing an existing connector.
Figure 17:
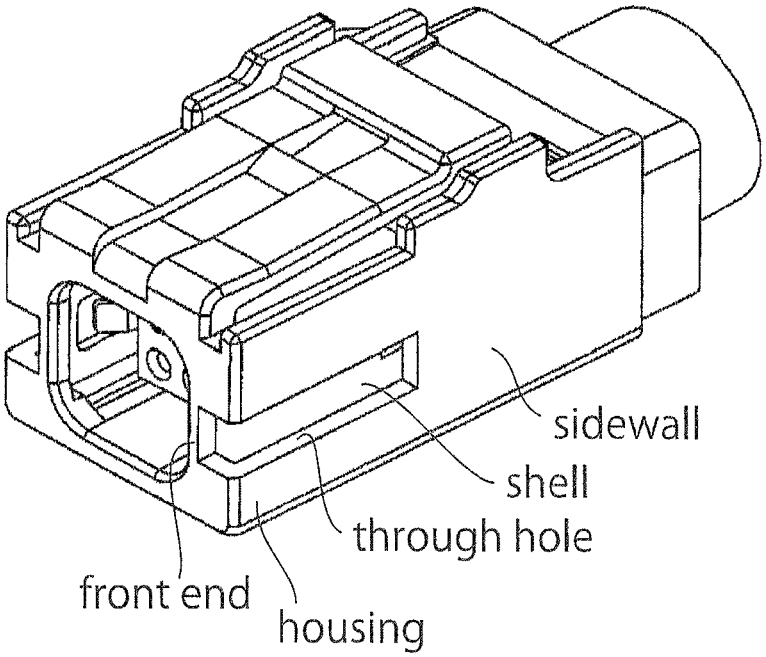
FIG. 17 PRIOR ART
FIG. 17 is a perspective view showing another existing connector.

As shown in FIGS. 13 to 15, each of the sidewalls 532 is provided with a guided portion 536 having a rectangular block-like shape. In other words, the mating connector 500 comprises the two guided portions 536. The guided portion 536 is formed on an inner surface of the sidewall 532. The guided portion 536 is located forward of the window 534. The guided portion 536 protrudes inward in the lateral direction (Y-direction). A size of the guided portion 536 in the up-down direction (Z-direction) is slightly smaller than a size of the guide ditch 248 of the connector 100 in the up-down direction (Z-direction). A distance between the two guided portions 536 in the lateral direction (Y-direction) is longer than a distance between the two protrusions 340 in the lateral direction (Y-direction) while shorter than a distance between the two outer surfaces 234 of the outer housing 200 of the connector 100. Thus configured guided portions 536 are guided by the guide ditches 248, respectively, when the mating connector 500 is mated with the connector 100.

As shown in FIG. 14, the receive portion 530 has a rear wall 538. The rear wall 538 is provided with a holding portion 540. The holding portion 540 is a hole which pierces the rear wall 538 in the front-rear direction (X-direction). The held portion 512 of the mating contact 510 is inserted in and held by the holding portion 540.

Figure 12:
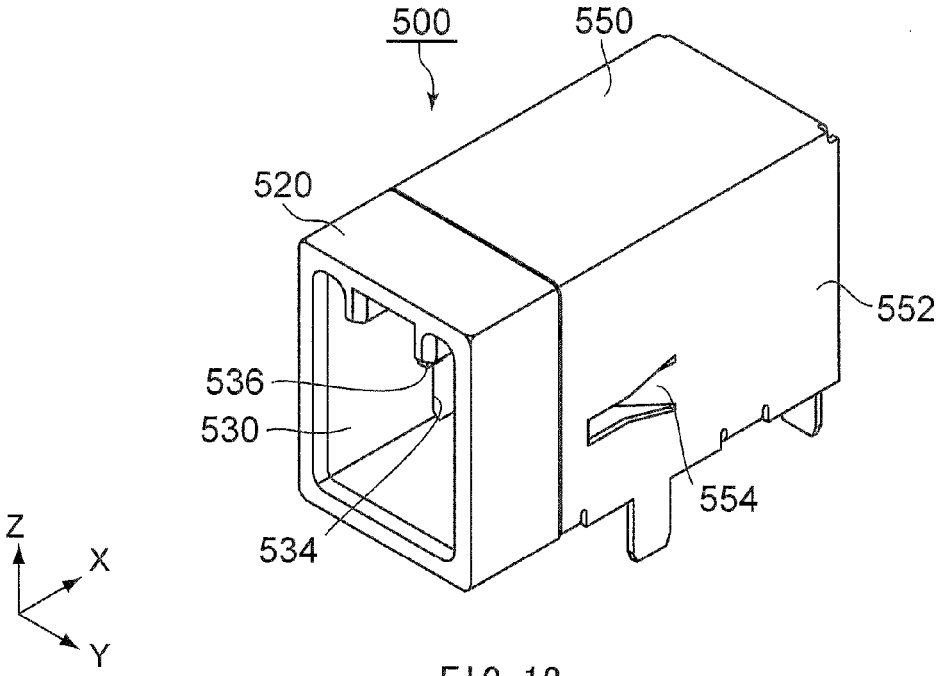
FIG. 12 is a perspective view showing a mating connector mateable with the connector of FIG. 1.

As shown in FIGS. 12 and 14, the mating shell 550 covers the positive X-side part of the mating housing 520. The mating shell 550 has two side plates 552. Each of the side plates 552 is provided with a contact portion 554 having a resiliency. In other words, the mating shell 550 has the two contact portions 554 each resiliently deformable. Each of the contact portions 554 has a dogleg shape. In detail, the contact portion 554 has an end fixed to the side plate 552 and another end formed with an end portion 556. The end portion 556 is supported so as to be movable.

As shown in FIG. 14, the contact portion 554 and the guided portion 536 are arranged to correspond to each other. More specifically, one of the guided portions 536 is provided between one of the contact portions 554 and the mating end of the mating connector 500, and another one of the guided portions 536 is provided between another one of the contact portions 554 and the mating end of the mating connector 500. Each of the contact portions 554 is located at nearly the same position as each of the guided portions 536 in the up-down direction (Z-direction). A size of the guided portion 536 in the up-down direction (Z-direction) is larger than a size of the contact portion 554 in the up-down direction (Z-direction). However, as shown in FIG. 15, a shortest distance between the two contact portions 554 in the lateral direction (Y-direction) is shorter than a shortest distance between the two guided portions 536 in the lateral direction (Y-direction). Accordingly, as shown in FIG. 13, a part of each of the contact portions 554 is visible when the mating connector 500 is seen from the mating end (i.e. positive X-side end). As shown in FIG. 15, the end portion 556 of the contact portion 554 is located outward of the guided portion 536 in the lateral direction (Y-direction). In other words, a distance between the two end portions 556 in the lateral direction (Y-direction) is longer than the shortest distance between the two guided portions 536 in the lateral direction (Y-direction). Accordingly, as shown in FIG. 13, the end portion 556 of the contact portion 554 is hidden by the guided portion 536 to be invisible when the mating connector 500 is seen from the mating end (i.e. positive X-side end). As can be seen from the above description, according to the present embodiment, the end portions 556 of the contact portions 554 are protected by the guided portions 536, respectively. It is therefore possible to prevent the contact portions 554 from being damaged.

As described above, the guided portions 536 are guided by the guide ditches 248, respectively, when the connector 100 is mated with the mating connector 500. Moreover, the guided portion 536 and the contact portion 554 are located at nearly the same position as each other in the up-down direction (Z-direction). As can be seen from the above description, when the connector 100 is mated with the mating connector 500, the contact portions 554 according to the present embodiment are also movable in the front-rear direction (X-direction) through the guide ditches 248, respectively. In other words, each of the guide ditches 248 allows the contact portion 554 to move in the front-rear direction (X-direction) without riding on the sidewall 230 of the outer housing 200 (i.e. without riding on the outer housing 200) when the connector 100 is mated with the mating connector 500. According to the present embodiment, the shortest distance between the two guide ditches 248 in the lateral direction (Y-direction) is shorter than the shortest distance between the two contact portions 554 in the lateral direction (Y-direction). Accordingly, it is possible to more securely prevent the contact portions 554 from riding on the outer housing 200.

When the connector 100 transits to a mated state where the connector 100 is mated with the mating connector 500, the contact portions 554 which move in the guide ditches 248 are brought into contact with the protrusions 340 located in the through holes 240, respectively. According to the present embodiment, the shortest distance between the two contact portions 554 in the lateral direction (Y-direction) is smaller than a size in the lateral direction (Y-direction) of an outline defined by the two protrusions 340. It is therefore possible to obtain a good contact. More specifically, under the mated state, the two contact portions 554 are pressed against and apply predetermined force to the two protrusions 340, respectively, so that the two contact portions 554 sandwich the shell 330. Accordingly, it is possible to obtain a good contact between the contact portion 554 and the protrusion 340.

According to the present embodiment, a size in the lateral direction (Y-direction) of an outline defined by the two body portions 336 of the shell 330 is smaller than the shortest distance between the two contact portions 554 in the lateral direction (Y-direction). Moreover, a shortest distance between the two guide ditches 248 in the lateral direction (Y-direction) is shorter than the shortest distance between the two side surfaces 334 of the shell 330 in the lateral direction (Y-direction). Accordingly, it is possible to obtain a cleaning effect of the contact portions 554. In detail, when the connector 100 and the mating connector 500 transit to the mated state, the contact portions 554 are brought into contact with and ride on the protrusions 340 from the body portions 336, respectively. Even if the outer housing 200 is shaven, the shavings attached to the contact portion 554 are removed when the contact portion 554 rides on the protrusion 340. Accordingly, a contact failure may not be caused by shavings, foreign bodies and contamination.

A shell of an existing connector is not provided with the protrusion 340. Accordingly, the contact portion 554 of the mating connector 500 slides on the shell by a long distance until the mating connector 500 is completely mated with the existing connector. The long distance sliding severely abrades the contact portion 554. Especially, when the mating connector 500 is repeatedly inserted in and removed from the existing connector, the sliding part of the contact portion 554 is largely shaven so that the life of the mating connector 500 becomes short. According to the present embodiment, the contact portion 554 of the mating connector 500 does not slide on the body portion 336 so that the sliding distance of the contact portion 554 is short. Accordingly, the abrasion of the contact portion 554 may be suppressed.

According to the present embodiment, the protrusion 340, which is configured to be brought into contact with the contact portion 554 of the mating connector 500, is visible through the through hole 240 in the lateral direction (Y-direction). Accordingly, it is possible to properly arrange the contact portion 554 in consideration of the position of the protrusion 340. More specifically, it is possible to arrange the contact portion 554 at a position where the outer housing 200 is not easily shaven.

The connector 100 according to the present embodiment is configured to be attached to the coaxial cable 50 so that the connector 100 has the single contact 310. However, the present invention is applicable to various connectors regardless of a type of cable and a number of contacts. For example, the connector may have a plurality of the contacts. For example, the connector may be attachable to a twinax cable or a cable having three or more signal lines.

The present application is based on a Japanese patent application of JP2012-107832 filed before the Japan Patent Office on May 9, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising:

a housing having an accommodation portion, two sidewalls and a coupling portion, the accommodation portion being located between the two sidewalls in a lateral direction, each of the sidewalls having a through hole, an upper sidewall and a lower sidewall, the through hole piercing the sidewall in the lateral direction to reach the accommodation portion, the upper sidewall being located on the through hole in an up-down direction perpendicular to the lateral direction, the lower sidewall being located under the through hole in the up-down direction, the coupling portion being located at a front side of the through hole in a front-rear direction perpendicular to both the lateral direction and the up-down direction, the coupling portion coupling the upper side wall and the lower sidewall to each other; and a terminal assembly accommodated in the accommodation portion along the front-rear direction, the terminal assembly having a shell, the shell having two side surfaces, each of the side surfaces having a body portion and a protrusion, the protrusion protruding outward in the lateral direction from the body portion, the protrusion being visible through the through hole from outside in the lateral direction;

wherein:

the connector is mateable along the front-rear direction with a mating connector comprising a mating shell having two contact portions each resiliently deformable, the protrusions of the connector being brought into contact with the contact portions of the mating connector, respectively, when the connector is in a mated state where the connector is mated with the mating connector;

each of the sidewalls of the housing is formed with a guide ditch, the guide ditch extending rearward from a front end of the housing, the guide ditch allowing the contact portion to move in the front-rear direction without riding on the housing when the connector is mated with the mating connector; and a part of the guide ditch constitutes, at least in part, the through hole.

2. The connector as recited in claim 1, wherein the protrusion is visible from front through the guide ditch.

3. The connector as recited in claim 1, wherein a part of the guide ditch pierces the sidewall of the housing in the lateral direction to constitute, at least in part, the through hole.

4. The connector as recited in claim 1, wherein a shortest distance between the two guide ditches in the lateral direction is shorter than a shortest distance between the two contact portions of the mating shell in the lateral direction.

5. The connector as recited in claim 1, wherein a size in the lateral direction of an outline defined by the two body portions is smaller than a shortest distance between the two contact portions of the mating shell in the lateral direction.

6. The connector as recited in claim 1, wherein a shortest distance between the two guide ditches in the lateral direction is shorter than a shortest distance between the two side surfaces of the shell in the lateral direction.

7. The connector as recited in claim 1, wherein each of the body portions is partially visible through the through hole from outside in the lateral direction.

8. The connector as recited in claim 1, wherein:

the terminal assembly is accommodated in the accommodation portion from a rear end of the housing;

the housing has an inner ditch formed on an inner surface of each of the sidewalls, the inner ditch extending forward from the rear end of the housing, the inner ditch allowing the protrusion to move forward when the terminal assembly is accommodated into the accommodation portion; and a part of the inner ditch constitutes, at least in part, the through hole.

9. The connector as recited in claim 1, wherein the protrusion is located inward of an outer surface of the sidewall of the housing in the lateral direction.

10. The connector as recited in claim 1, wherein:

the housing has a front wall, the front wall being located in front of the accommodation portion, the front wall coupling the two sidewalls; and the coupling portion is a part of the front wall.

11. The connector as recited in claim 10, wherein:

the shell has a front surface, the front surface of the shell constituting, at least in part, a front surface of the terminal assembly; and the front wall of the housing is formed with a hole which reaches the front surface of the shell in the front-rear direction.

12. The connector as recited in claim 1, wherein:

the terminal assembly further has a contact and an inner housing which holds the contact; and the shell covers, at least in part, the inner housing.

13. A mating connector mateable with the connector as recited in claim 1, the mating connector comprising:

a mating end configured to be mated with the connector; and two guided portions each provided between the contact portion and the mating end, the guided portions being guided by the guide ditches, respectively, when the mating connector is mated with the connector.

14. The mating connector as recited in claim 13, wherein a shortest distance between the two guided portions in the lateral direction is longer than a shortest distance between the two contact portions of the mating shell in the lateral direction.

* * * * *